US010106957B2

(12) United States Patent
Kim et al.

(10) Patent No.: US 10,106,957 B2
(45) Date of Patent: Oct. 23, 2018

(54) DEVICE AND METHOD FOR CONTROLLING HYDRAULIC PUMP IN CONSTRUCTION MACHINE

(71) Applicant: Doosan Infracore Co., Ltd., Incheon (KR)

(72) Inventors: Chang Muk Kim, Yongin-si (KR); Woo Yong Jung, Yongin-si (KR); Young Sik Cho, Yongin-si (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 36 days.

(21) Appl. No.: 14/780,650

(22) PCT Filed: Mar. 28, 2014

(86) PCT No.: PCT/KR2014/002665
§ 371 (c)(1),
(2) Date: Sep. 28, 2015

(87) PCT Pub. No.: WO2014/157988
PCT Pub. Date: Oct. 2, 2014

(65) Prior Publication Data

US 2016/0040689 A1 Feb. 11, 2016

(30) Foreign Application Priority Data

Mar. 29, 2013 (KR) ..... 10-2013-0034252

(51) Int. Cl.
*E02F 9/22* (2006.01)
*F02D 29/04* (2006.01)
(Continued)

(52) U.S. Cl.
CPC ..... *E02F 9/2246* (2013.01); *E02F 9/2235* (2013.01); *E02F 9/2292* (2013.01);
(Continued)

(58) Field of Classification Search
CPC .. F15B 2211/20546; F15B 2211/20523; F15B 2211/20576; F15B 2211/6351;
(Continued)

(56) References Cited

U.S. PATENT DOCUMENTS 4,606,313 A * 8/1986 Izumi ..... B60W 10/06 123/357
6,183,210 B1 * 2/2001 Nakamura ..... E02F 9/2235 417/222.1
(Continued)

FOREIGN PATENT DOCUMENTS

CN 105051292 11/2015
EP 0945619 9/1999
(Continued)

OTHER PUBLICATIONS

Search Report issued in related European Patent Application 14776506.9 dated Oct. 21, 2016. 9 pages.
(Continued)

*Primary Examiner* — F. Daniel Lopez
*Assistant Examiner* — Michael Quandt
(74) *Attorney, Agent, or Firm* — K&L Gates LLP

(57) ABSTRACT

Disclosed are a device and a method for controlling a hydraulic pump in a construction machine, the method including: checking whether a dynamic characteristic of an engine deviates from a predetermined permissible range when a load is applied to the hydraulic pump and a pump load reaches pump torque required by the hydraulic pump; when the dynamic characteristic of the engine deviates from the predetermined permissible range, applying a pump load to the hydraulic pump so as to increase the pump torque to predetermined torque with a predetermined change rate; collecting information which is generated when the pump load is applied; generating a new torque change rate map by
(Continued)

generating a torque change rate for each load section based on the information collected in the information collecting step; and updating an existing torque change rate map to the new torque change rate map generated in the map data generating step.

8 Claims, 11 Drawing Sheets

(51) Int. Cl.
*F15B 21/08* (2006.01)
*F04B 17/05* (2006.01)

(52) U.S. Cl.
CPC ..... *E02F 9/2296* (2013.01); *F02D 29/04* (2013.01); *F15B 21/087* (2013.01); *F04B 17/05* (2013.01); *F15B 2211/20523* (2013.01); *F15B 2211/20546* (2013.01); *F15B 2211/20576* (2013.01); *F15B 2211/426* (2013.01); *F15B 2211/633* (2013.01); *F15B 2211/6309* (2013.01); *F15B 2211/6313* (2013.01); *F15B 2211/6333* (2013.01); *F15B 2211/6652* (2013.01); *F15B 2211/6656* (2013.01)

(58) Field of Classification Search
CPC ..... F15B 2211/6352; F15B 2211/6309; F15B 2211/633; F15B 2211/6333
See application file for complete search history.

(56) References Cited

U.S. PATENT DOCUMENTS

| | | | | |
|---|---|---|---|---|
| 8,136,355 | B2 * | 3/2012 | Yasuda | F04C 14/065 60/449 |
| 8,347,619 | B2 * | 1/2013 | Kim | E02F 9/2066 417/216 |
| 9,206,798 | B2 * | 12/2015 | Jung | E02F 9/2235 |
| 9,260,838 | B2 * | 2/2016 | Sawada | E02F 9/2235 |

FOREIGN PATENT DOCUMENTS

| | | |
|---|---|---|
| JP | 2003-333876 | 11/2003 |
| KR | 0457365 | 11/1991 |
| KR | 10-2010-0069725 | 6/2010 |
| KR | 10-2010-0072473 | 7/2010 |
| KR | 10-2012-0116485 | 10/2012 |
| KR | 10-1189632 | 10/2012 |

OTHER PUBLICATIONS

International Search Report for International Patent Application PCT/KR2014/002665 dated Jul. 7, 2014. 4 pages.
Office Action issued in related Chinese Patent Application 201480018657.9 dated Jul. 1, 2016.

* cited by examiner

DEVICE AND METHOD FOR CONTROLLING HYDRAULIC PUMP IN CONSTRUCTION MACHINE

CROSS REFERENCE TO RELATED APPLICATIONS

The present application is a National Stage of International Application No. PCT/KR2014/002665, filed on Mar. 28, 2014, which claims priority to Korean Patent Application No. 10-2013-0034252, filed on Mar. 29, 2013, the entire contents of each of which are being incorporated herein by reference.

FIELD OF THE DISCLOSURE

The present disclosure relates to a device and a method for controlling a hydraulic pump in a construction machine, and more particularly, to a device and a method for controlling a hydraulic pump in a construction machine, which are capable of controlling a hydraulic pump by reflecting a changed dynamic characteristic of an engine.

BACKGROUND OF THE DISCLOSURE

In general, a hydraulic system is mounted in a construction machine to operate various operating devices. The hydraulic system receives power from an engine and operates a hydraulic pump, and operates various operating devices by working oil discharged from the hydraulic pump.

An electronically controllable electronic hydraulic pump is known as the hydraulic pump. Further, the hydraulic pump includes a hydraulic pump in a pressure control type.

The pressure control type electronic hydraulic pump may control a size of finally output pump torque by electronically controlling an angle of a swash plate. Further, the pressure control type electronic hydraulic pump is a type that controls pressure of the pump in proportion to a detected pressure value of working oil.

Hereinafter, the "pressure control type electronic hydraulic pump" is abbreviated as a "pump".

As the related art, Patent Literature 1, "Apparatus and Method for Controlling Hydraulic Pump for Construction Machine", which was filed by the applicant of the present disclosure and published is known.

Patent Document 1 relates to a method of controlling output torque of a hydraulic pump, and is a technology of mapping torque response performance of an engine with a time constant corresponding to a pump torque control means based on an engine speed.

In order to find a time constant used for the control in Patent Literature 1, it is very important to recognize a dynamic characteristic according to an engine speed, and the hydraulic system in the related art controls output torque of a hydraulic pump by setting a time constant based on a reach of a load pattern from a standby load (zero or a predetermined level) to a full load.

In the time constant control method, when a load is not the full load, a change rate of output torque of a hydraulic pump is decreased, so that an engine speed is not decreased, but an operation speed is unintentionally decreased, thereby degrading workability.

On the other hand, performance of the engine is degraded according to an increase in the operation time thereof, so that the dynamic characteristic of the engine is changed. Accordingly, there is a problem in that even though the pump is controlled by loading a torque change rate map for each load, to which a dynamic characteristic of the engine is reflected, when a dynamic characteristic of the engine is changed, the already loaded torque change rate map for each load cannot smoothly control the hydraulic pump.

SUMMARY

Accordingly, a technical object to be solved by the present disclosure is to provide a device and a method for controlling a hydraulic pump in a construction machine, which are capable of controlling output torque of a hydraulic pump by recognizing a changed dynamic characteristic of an engine when it is determined that performance of the engine deteriorates, and providing a new torque change rate map for each load range so that the changed dynamic characteristic of the engine is reflected.

A technical object to be achieved in the present disclosure is not limited to the aforementioned technical objects, and another not-mentioned technical object will be obviously understood from the description below by those with ordinary skill in the art to which the present disclosure pertains.

In order to solve the technical problems of the present disclosure, an exemplary embodiment of the present disclosure provides a method for controlling a hydraulic pump in a construction machine, the method including: an engine dynamic characteristic change checking step (S20 of checking whether a dynamic characteristic of an engine deviates from a predetermined permissible range when a load is applied to the hydraulic pump and a pump load reaches pump torque required by the hydraulic pump; a pump load applying step S40 of when the dynamic characteristic of the engine deviates from the predetermined permissible range in the engine dynamic characteristic change checking step S20, applying a pump load to the hydraulic pump so as to increase the pump torque to predetermined torque with a predetermined change rate; an information collecting step S50 of collecting information including engine speed information, swash plate angle information of the pump, and pressure information of discharged working oil, which is generated when the pump load is applied in the pump load applying step S40; a map data generating step S60 of generating a new torque change rate map 220*a* by generating a torque change rate for each load section based on the information collected in the information collecting step S50; and an updating step S80 for updating an existing torque change rate map 220 to the new torque change rate map 220*a* generated in the map data generating step S60, in which the hydraulic pump is controlled by the new torque change rate map 220*a* updated in the updating step S80.

The permissible range of the dynamic characteristic of the engine predetermined in the engine dynamic characteristic change checking step S20 may be an engine speed of 90 rpm or more and 110 rpm or less.

The map data generating step S60 may include generating the new torque change rate map 220*a* by defining load sections by dividing a load of the hydraulic pump into a plurality of load sections from a minimum level to a maximum level, calculating a time taken to reach each load section at a normal engine speed, calculating a matched pump load, in which each taken time is matched to the engine speed, defining a new torque change rate based on an amount of increase of the matched pump load at each taken time, and calculating new torque change rates R11, R21, R31, R41, and R51 for the load sections, respectively.

In the engine dynamic characteristic change checking step S20, when a degree of the change of the dynamic characteristic of the engine is within the permissible range, updating the torque change rate map may not be performed.

The method may further include an input means selecting step S30 of selecting an input means in order to set a torque change rate in the pump load applying step S40.

The information collected in the information collecting step S50 may include an engine speed, a boost pressure, a swash plate angle of the pump, and a pressure of working oil discharged from the pump.

The method may further include a comparing step S70 of comparing the new torque change rate newly generated in the map data generating step S60 with an existing torque change rate for each load section, and determining whether a difference in a torque change rate is within a permissible range, in which when the difference in the torque change rate deviates from the permissible range in the comparing step S70, the new torque change rate map 220*a* is generated based on the newly generated torque change rate.

The permissible range of the difference in the torque change rate in the comparing step S70 may be 10% or more of an increase/decrease ratio of the new torque change rate to the existing torque change rate.

In order to solve the technical problems of the present disclosure, another exemplary embodiment of the present disclosure provides a device for controlling, a hydraulic pump in a construction machine, the device including: a horsepower controller 110 configured to control horsepower of a hydraulic pump and a flow rate controller 120 configured to control a flow rate of the hydraulic pump by receiving information from a request unit 10, a load mode selecting unit 20, an engine speed setting unit 30, an engine control unit (ECU) 40; a torque distribution controller 130 configured to calculate a sum of torque required by processing the information collected by the horsepower controller 110, recognize a degree of currently discharged flow rate by receiving swash plate angle information of first and second hydraulic pumps P1 and P2 from the flow rate controller 120, calculate a degree of torque to be required in the future by adding or subtracting a flow rate requested by the request unit 10, and distribute the calculated torque into the first hydraulic pump P1 and the second hydraulic pump P2; a pump controller 140 configured to receive from the flow rate controller 120 a pressure command Pi indicating a size of pressure to be required in the future, receive from the torque distribution controller 130 a torque command Pd to be handled by each of the first hydraulic pump P1 and the second hydraulic pump P2 according to a torque size ratio received from the flow rate controller 120 in the sum of torque received from the horsepower controller 110, select the smallest value among a maximum pump pressure value Pmax, a value of the pressure command Pi, and a value of the distributed torque command Pd, and output the selected value as a pump command value, and divide and output the pump command value into a first pump command Pcmd1 controlling the first hydraulic pump P1 and a second pump command Pcmd2 controlling the second hydraulic pump P; and a torque controller 200 including a torque calculating unit 210, which calculates a torque value based on the first pump command Pcmd1 and the second pump command Pcmd2 and swash plate angles of the first and second hydraulic pumps P1 and P2, which are provided from the pump controller 140, and a newly loaded new torque change rate map 220*a*, and configured to generate and output first and second correction pump commands Pcmd11 and Pcmd22 controlling the first and second hydraulic pumps P1 and P2 by reflecting a torque change rate value of the new torque change rate map 220*a*.

In the device and the method for controlling the hydraulic pump in the construction machine according to the present disclosure configured as described above, when a normal output is not made due to deterioration or a change of an engine in a hydraulic system, in which a pressure control type electronic hydraulic pump is mounted, a hydraulic pump is controlled by a torque change rate map for each load range, to which a dynamic characteristic of the engine is reflected, so that it is possible to improve the amount of decrease of an engine speed according to a variation of a pump load.

Further, the device and the method for controlling the hydraulic pump in the construction machine according to the present disclosure may improve a degree of variation of a pump load and further improve performance of controlling an operating device.

DETAILED DESCRIPTION

Figure 1:
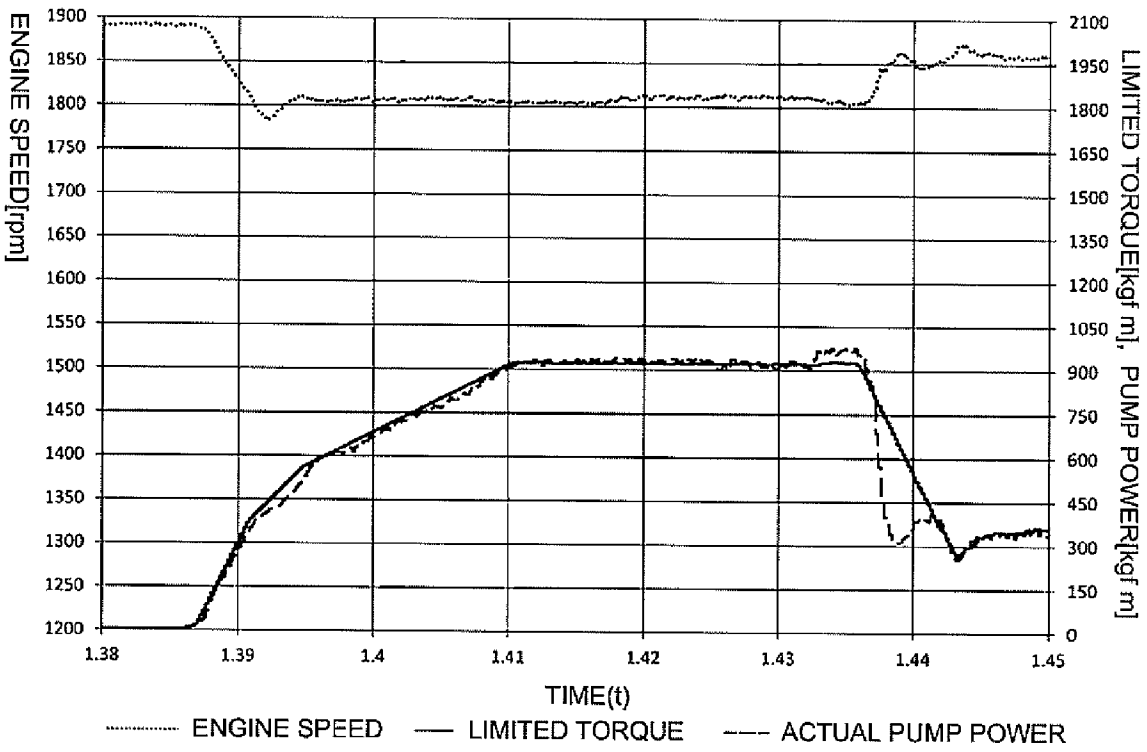
FIG. 1 is a diagram for describing a case where a dynamic characteristic of an engine is normal in a device for controlling a hydraulic pump in a construction machine.

Advantages and characteristics of the present disclosure, and a method of achieving the advantages and characteristics will be clear with reference to an exemplary embodiment to be described in detail together with the accompanying drawings.

Hereinafter, an exemplary embodiment of the present disclosure will be described in detail with reference to the accompanying drawings. It should be appreciated that the exemplary embodiment, which will be described below, is illustratively described for helping the understanding of the present disclosure, and the present disclosure may be variously modified to be carried out differently from the exemplary embodiment described herein. In the following description of the present disclosure, a detailed description and a detailed illustration of publicly known functions or constituent elements incorporated herein will be omitted when it is determined that the detailed description may unnecessarily make the subject matter of the present disclosure unclear. Further, the accompanying drawings are not illustrated according to an actual scale, but sizes of some constituent elements may be exaggerated to help understand the present disclosure.

Further, the terms used in the description are defined considering the functions of the present disclosure and may vary depending on the intention or usual practice of a manufacturer. Therefore, the definitions should be made based on the entire contents of the present specification.

Like reference numerals indicate like elements throughout the specification.

First, a correlation between a required load and a dynamic characteristic of an engine when a pump and the engine are controlled by a device for controlling a hydraulic pump in a construction machine will be described with reference to FIGS. 1 to 4.

FIG. 1 is a diagram for describing a case where a dynamic characteristic of the engine is normal in the device for controlling the hydraulic pump in the construction machine.

As illustrated in FIG. 1, it can be seen that when the pump is normally controlled by the device for controlling the hydraulic pump in the construction machine, a drop phenomenon of an engine speed is not large, and a rated engine speed is maintained. Here, 1,800 rpm is set as the rated engine speed as an example.

A torque change rate map for each load range when the pump is normally controlled by the device for controlling the hydraulic pump in the construction machine will be described with reference to FIGS. 2 to 4.

Figure 2:
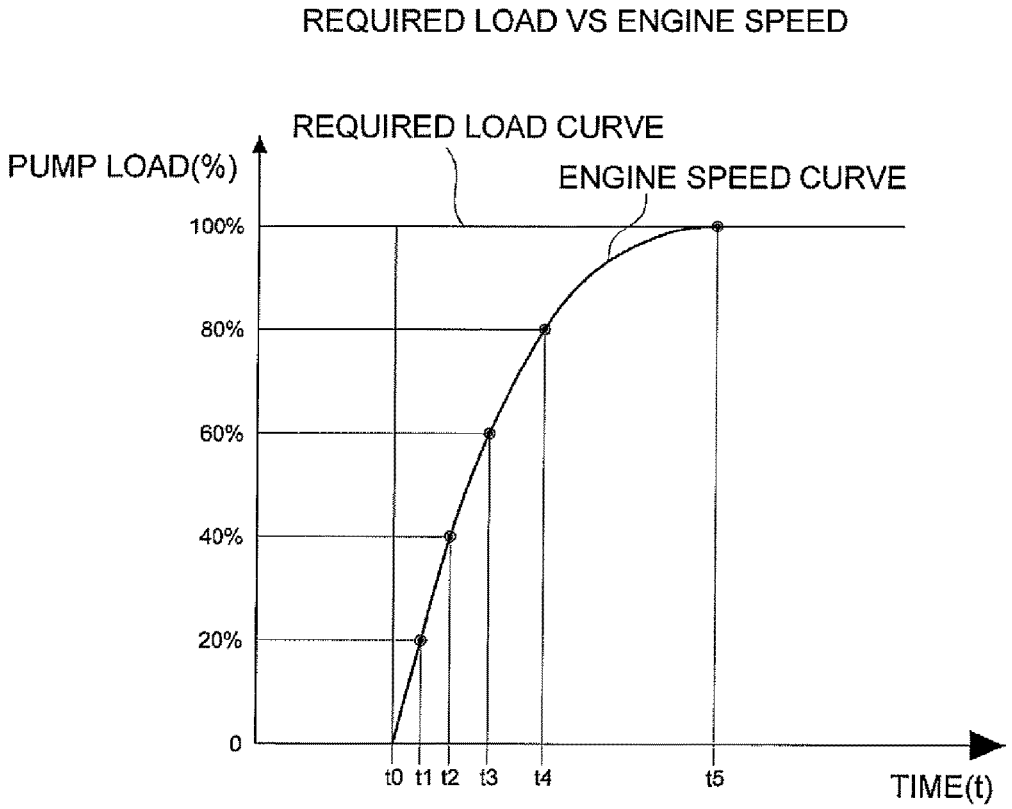
FIG. 2 is a diagram illustrating a correlation between a required load and an engine speed when a dynamic characteristic of an engine is normal in the device for controlling the hydraulic pump in the construction machine.

FIG. 2 is a diagram illustrating a correlation between a required load and an engine speed when a dynamic characteristic of the engine is normal in the device for controlling the hydraulic pump in the construction machine. FIG. 3 is a diagram illustrating an example of calculating a torque change rate for each load section when a dynamic characteristic of the engine is normal in the device for controlling the hydraulic pump in the construction machine. FIG. 4 is a diagram illustrating an example, in which a torque change rate map for each load range is made based on the torque change rate of FIG. 3.

As illustrated in FIG. 2, when a joystick is sharply operated, so that a pump load is maximally (100%) required, an engine speed is increased with a torque change rate in order to generate torque corresponding to the pump load. The torque change rate may be understood as an increase quantity of engine speed with respect to a time passage. A torque change rate may be differently set for each load section, and an assembly of the torque change rates is referred to as a torque change rate map.

Figure 3:
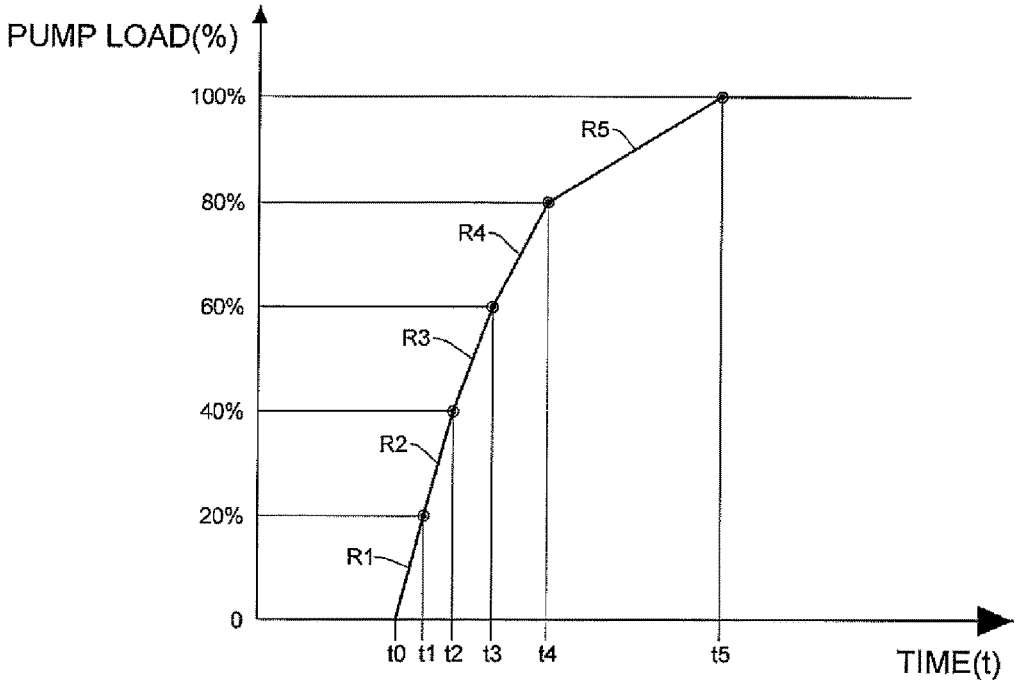
FIG. 3 is a diagram illustrating an example of calculating a torque change rate for each load section when a dynamic characteristic of an engine is normal in the device for controlling the hydraulic pump in the construction machine.

That is, the torque change rate map is generated by dividing a load section from a level, at which a load is not applied, or a normal level to a maximum value into sections, and setting a torque change rate, at which an engine speed is increased for each section, as illustrated in FIG. 3. In the exemplary embodiment of the present disclosure, the example, in which a load section is divided into five sections, is described, but the present disclosure is not limited thereto, and as a load section is subdivided, the number of torque change rates is increased, and thus t is possible to more precisely control the hydraulic pump.

A first torque change rate R1 is a change rate of a first time t1 taken from a torque required time to a time at which a pump load reaches 20%.

A second torque change rate R2 is a change rate of a second time t2 until the pump load reaches 40% from 20%.

Similarly, third to fifth torque change rates R3 to R5 are change rates of third to fifth times t3 to t5 taken in sections of the respective loads.

Figure 4:
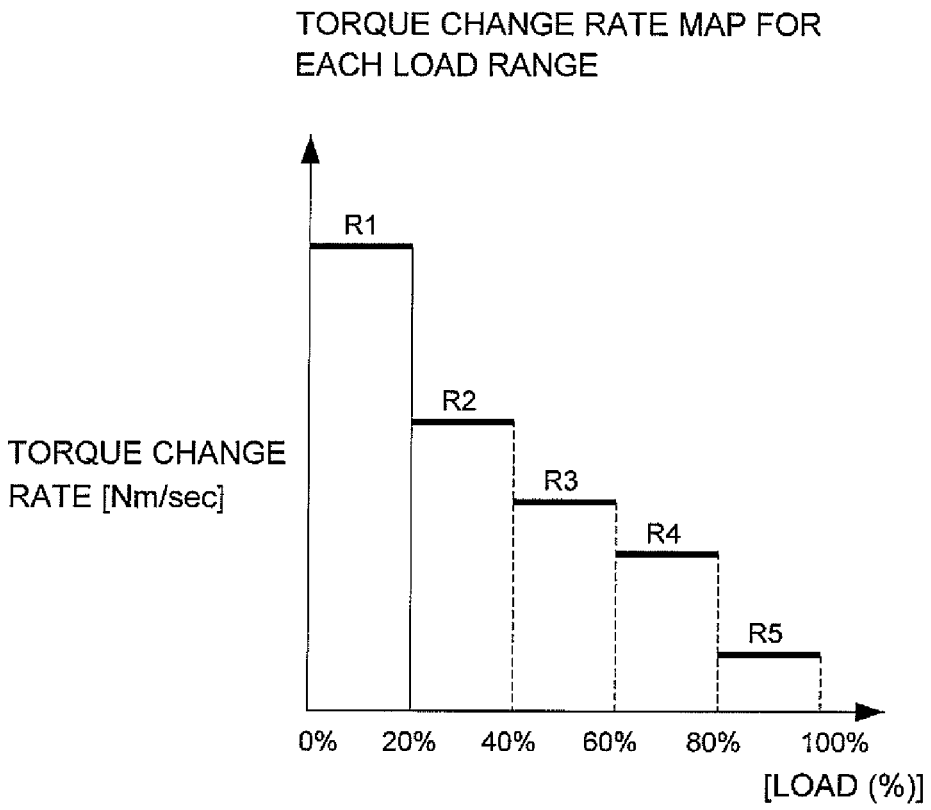
FIG. 4 is a diagram illustrating an example, in which a torque change rate map for each load range is made based on the torque change rate of FIG. 3.

FIG. 4 is a map of the torque change rate for each pump load calculated in FIG. 3. As illustrated in FIG. 4, each pump load has a torque change rate. Accordingly, when the pump is controlled by the hydraulic system, a pump control command, to which the torque change rate map is reflected, is generated, and the pump is controlled by the pump control command.

Figure 5:
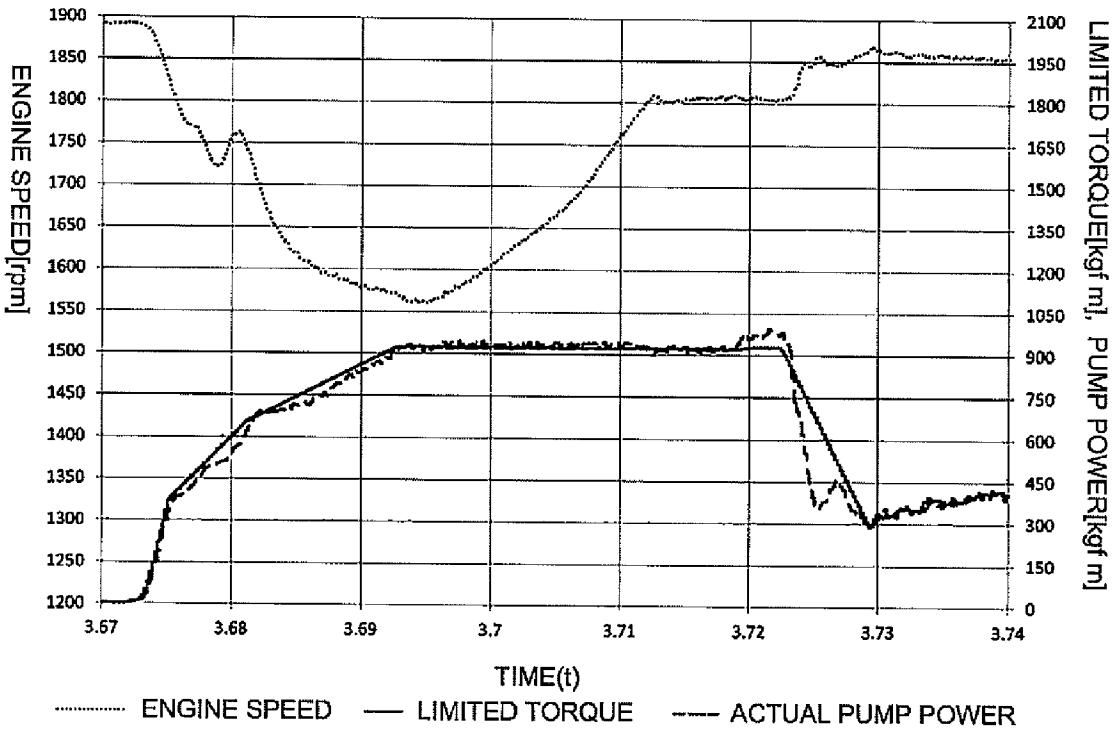
FIG. 5 is a diagram for describing a case where a dynamic characteristic of an engine is changed in the device for controlling the hydraulic pump in the construction machine.

FIG. 5 illustrates an example, in which a dynamic characteristic of the engine is changed.

It can be seen that when a dynamic characteristic of the engine is changed, a command similar to limited torque is given as illustrated in FIG. 1, and thus, even when actual pump power is equally/similarly generated, and there occurs an engine speed decrease phenomenon, in which an engine speed is considerably lower than a rated engine speed at a specific time. When it is assumed that the rated engine speed is 1,800 rpm, the engine speed is close to 1,550 rpm, which is low, at a time to reach the required torque. When the engine speed is excessively low as described above, the large amount of fuel is consumed in order to generate required torque.

Accordingly, when a dynamic characteristic of the engine is changed, the hydraulic pump of the hydraulic system in the construction machine needs to be controlled so that the changed dynamic characteristic of the engine is reflected.

Hereinafter, a device for controlling a hydraulic system in a construction machine according to an exemplary embodiment of the present disclosure will be described with reference to FIG. 6.

Figure 6:
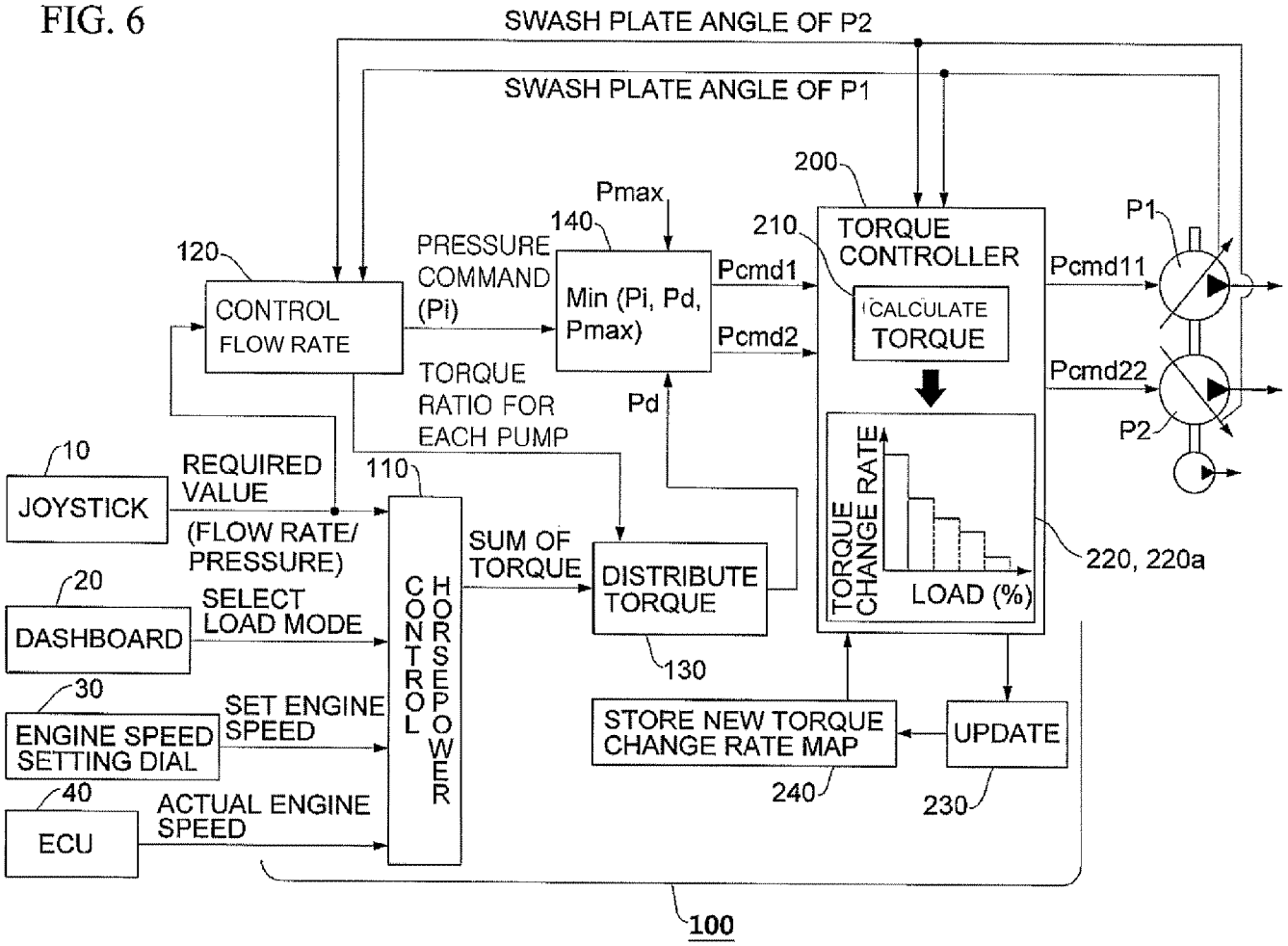
FIG. 6 is a diagram for describing a device for controlling a hydraulic pump in a construction machine according to an exemplary embodiment of the present disclosure.

FIG. 6 is a diagram for describing a device for controlling a hydraulic pump in a construction machine according to an exemplary embodiment of the present disclosure.

A hydraulic pump control device 100 generates a flow rate and hydraulic pressure of working oil discharged from a plurality of first and second hydraulic pumps P1 and P2 in response to required pump torque. The pump torque is calculated by multiplying a flow rate discharged per unit rotation and a pressure formed at the flow rate.

The hydraulic pump control device 100 includes a horsepower controller 110 and a flow rate controller 120 for controlling the hydraulic pump. The horsepower controller 110 receives information from a request unit 10, a load mode selecting unit 20, an engine speed setting unit 30, and an engine control unit (ECU) 40.

The request unit 10 may include a joystick, a pedal, and the like. For example, when a joystick is operated with a maximum displacement, a request signal for a request value (flow rate/pressure) is generated, and the request signal is provided to the horsepower controller 110 and the flow rate controller 120. The request signal may be understood as a size of torque to be generated by the pump torque.

The load mode selecting unit 20 selects a load mode according to lightness and heaviness of an operation desired to be performed by an operator. For example, the load mode selecting unit 20 selects a load mode on a dashboard, and selects any one load mode among an excessively heavy mode, a heavy load mode, a standard load mode, a light load mode, and an idle mode. When a higher load mode is selected, high pressure is formed in working oil discharged from the hydraulic pump, and when a lower load mode is selected, a flow rate of working oil discharged from the hydraulic pump is increased.

The engine speed setting unit 30 enables a manager to arbitrarily select an engine speed. For example, an operator sets a desired engine speed by adjusting an engine speed dial. When an engine speed is set to be large, the engine may provide larger power to the hydraulic pump, but there is a concern in that fuel consumption may relatively increase and durability of the construction machine may deteriorate, so that it is preferable to set an appropriate engine speed. In a case of the standard load mode, an engine speed may be set to about 1,400 rpm, and may also be set to be larger or smaller according to a tendency of an operator.

The ECU 40 is a device controlling the engine, and provides an actual engine speed information to the horsepower controller 110.

The horsepower controller 110 calculates a sum of required torque by processing the collected information, and the sum of the torque is provided to the torque distribution controller 130.

In the meantime, the flow rate controller 120 recognizes a degree of a currently discharged flow rate by receiving information on swash plate angles of the first and second hydraulic pumps P1 and P2, and calculates a degree of torque to be required in the future by adding or subtracting a flow rate requested by the request unit 10 to or from the recognized flow rate. In the meantime, the hydraulic pump includes the first hydraulic pump P1 and the second hydraulic pump P2, so that a torque ratio is determined for each hydraulic pump and the information on the determined torque ratio is provided to the torque distribution controller 130.

Further, the flow rate controller 120 calculates a degree of pressure to be required in the future, and provides the required pressure to the pump controller 140 as a pressure command Pi.

The torque distribution controller 130 provides the pump controller with a torque command Pd of a torque size to be handled by each of the first hydraulic pump P1 and the second hydraulic pump P2 according to a torque size ratio received from the flow rate controller 120 in the sum of the torque received from the horsepower controller 110. The torque command Pd includes a control signal for controlling each of the first and second hydraulic pumps P1 and P2.

The pump controller 140 selects the smallest value among a maximum pump pressure value Pmax, a value of the pressure command Pi, and a value of the distributed torque command Pd and outputs the selected value as a pump command value, and the pump command value is divided and output into a first pump command Pcmd1 controlling the first hydraulic pump P1 and a second pump command Pcmd2 controlling the second hydraulic pump P2.

In a general situation, the aforementioned first and second pump commands Pcmd1 and Pcmd2 are provided to the first and second hydraulic pumps P1 and P2, respectively, and the first and second hydraulic pumps P1 and P2 generate discharged flow rates and discharged pressures of working oil according to the first and second pump commands Pcmd1 and Pcmd2.

However, a dynamic characteristic of the engine may be changed due to deterioration of the engine or an external reason.

The device 100 for controlling the hydraulic pump according to the present disclosure includes a torque controller 200 to stably control the first and second hydraulic pumps P1 and P2 based on the first and second pump commands Pcmd1 and Pcmd2.

The torque controller 200 includes a torque calculating unit 210 and previous and new torque change rate maps 220 and 220*a*.

The torque calculating unit 210 calculates pump torque with Equation 1 below.

$$T=P*Q*A \quad \text{[Equation 1]}$$

Size of pump torque generated by the hydraulic pump

P: Pressure P of working oil discharged from the hydraulic pump

Q: Flow rate Q of working oil discharged from the hydraulic pump per unit rotation A: Constant A for converting intensity of power from a unit of KGM into a unit of horsepower (ps) torque The previous torque change rate map 220 is provided with reflection of a dynamic characteristic of the engine according to a hydraulic load as described with reference to FIGS. 2 to 4.

The torque controller 200 generates and outputs first and second correction pump commands Pcmd11 and Pcmd22 to finally control the first and second hydraulic pumps P1 and P2 by reflecting a torque change rate value to the torque value calculated by the torque calculating unit 210.

That is, the aforementioned torque change rate map 220 is a value, to which a dynamic characteristic of the engine is reflected, so that the finally generated first and second correction pump commands Pcmd11 and Pcmd22 are pump control command values, to which the dynamic characteristic of the engine is reflected.

In the meantime, as illustrated in FIG. 5, when the hydraulic pump of the hydraulic system is not normally controlled, and the engine speed is excessively decreased at a specific section due to the change in the dynamic characteristic of the engine, the torque change rate map 220 loaded in the torque controller 200 under the control of the device for controlling the hydraulic pump in the construction machine according to the present disclosure.

An exemplary embodiment, in which the torque change rate map 220 according to the present disclosure is updated, will be described with reference to FIGS. 7 to 11.

Figure 7:
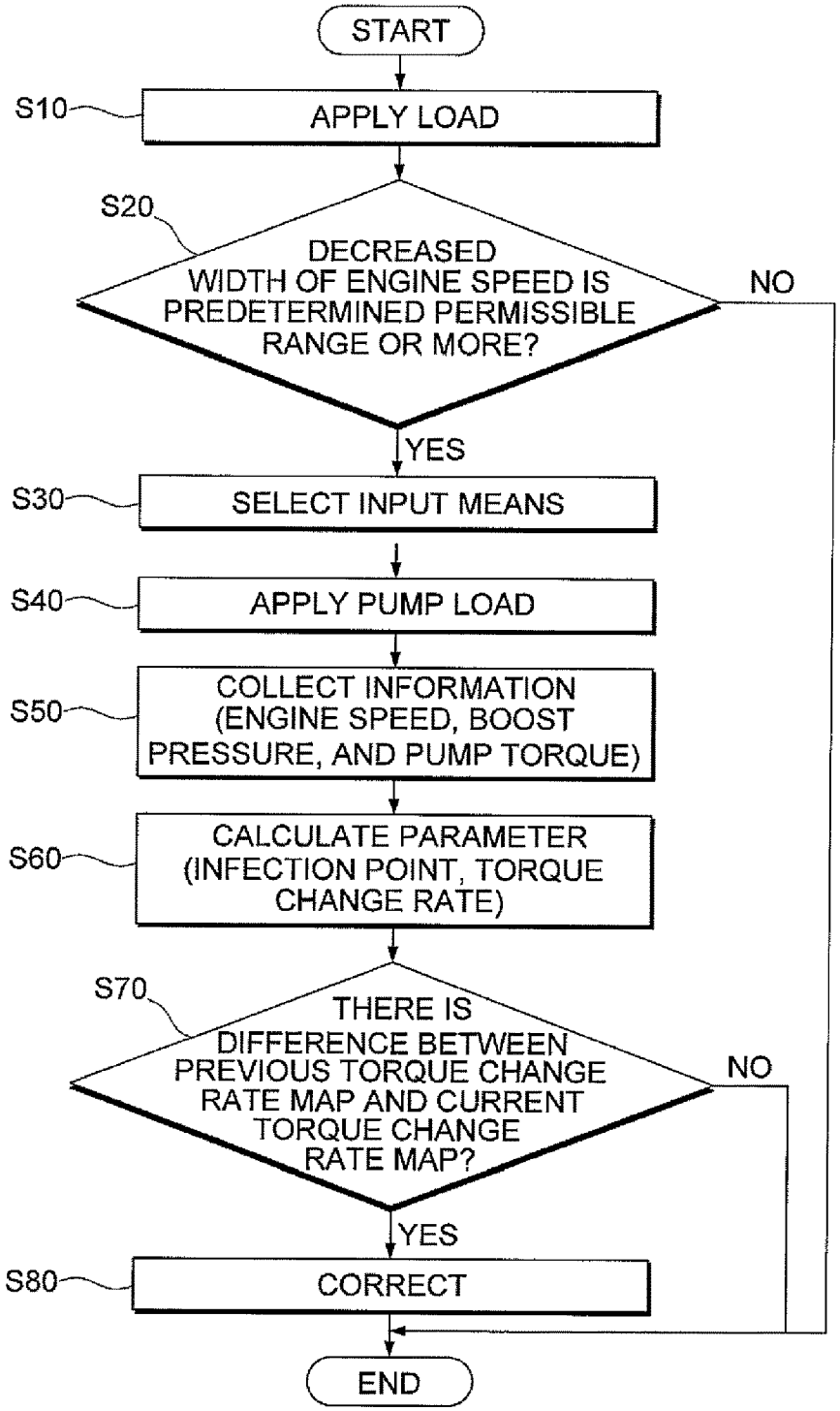
FIG. 7 is a diagram for describing an example of reflecting a new torque change rate map in a state where a dynamic characteristic of an engine is changed in the device for controlling the hydraulic pump in the construction machine according to the exemplary embodiment of the present disclosure.
Figure 8:
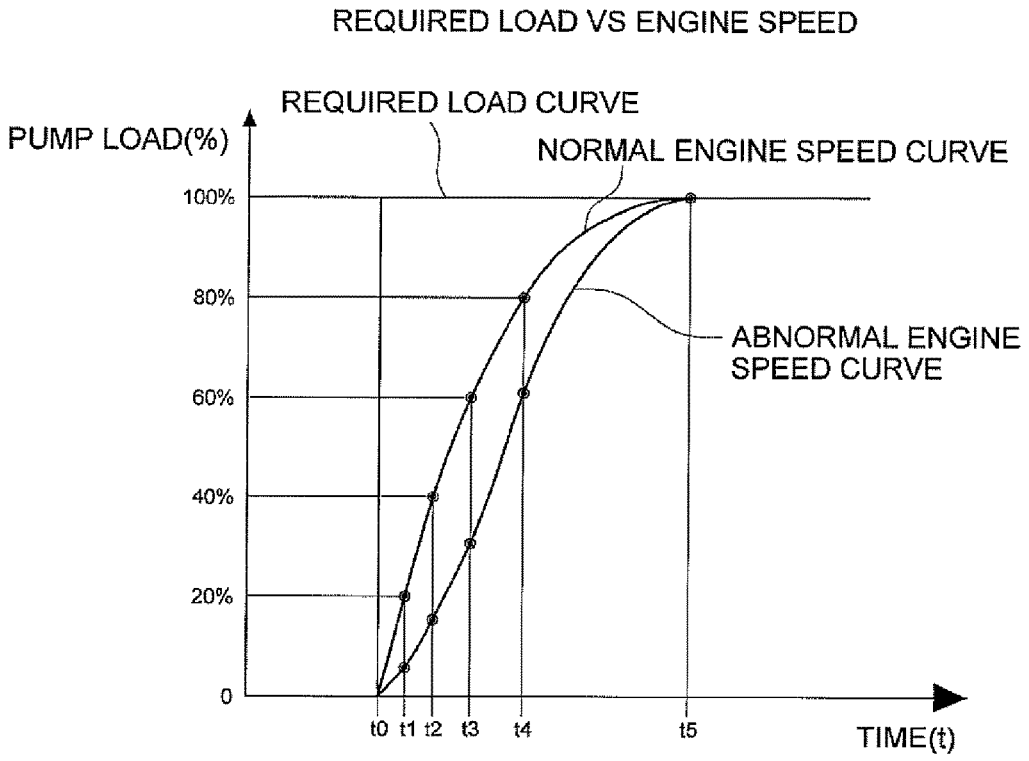
FIG. 8 is a diagram illustrating a correlation between a required load and an engine speed when a dynamic characteristic of an engine deteriorates in the device for controlling the hydraulic pump in the construction machine.
Figure 9:
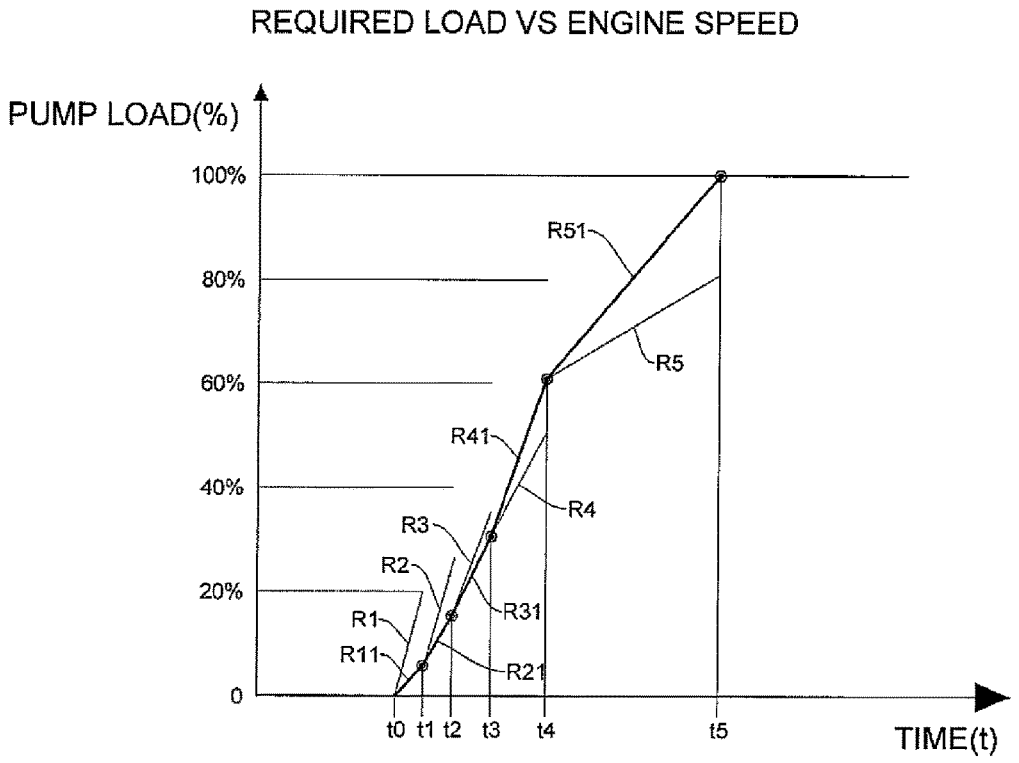
FIG. 9 is a diagram illustrating an example of calculating a torque change rate for each load section when a dynamic characteristic of an engine deteriorates in the device for controlling the hydraulic pump in the construction machine.
Figure 10:
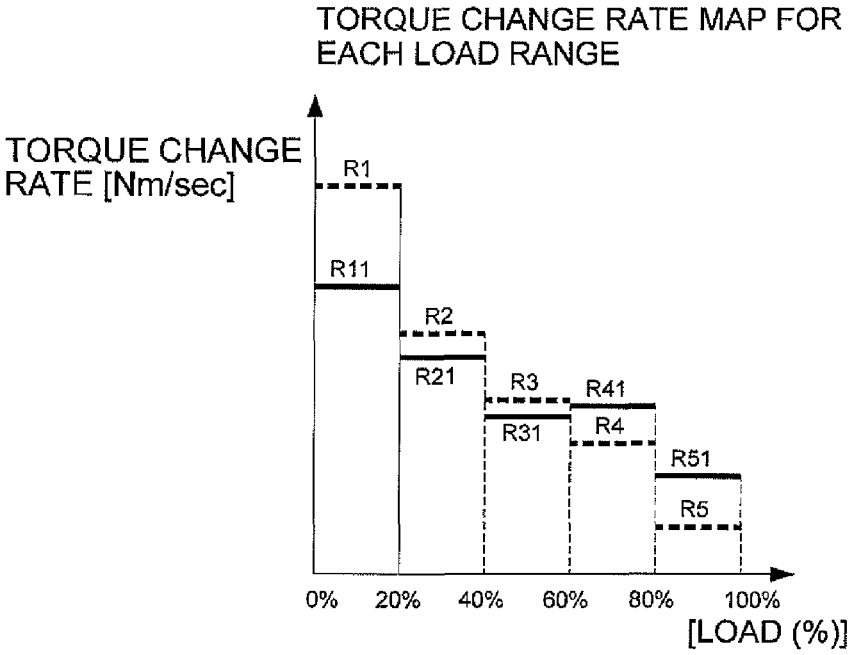
FIGS. 10 and 11 are diagrams illustrating an example, in which a new torque change rate map for each load range is made based on the new torque change rate of FIG. 9.
Figure 11:
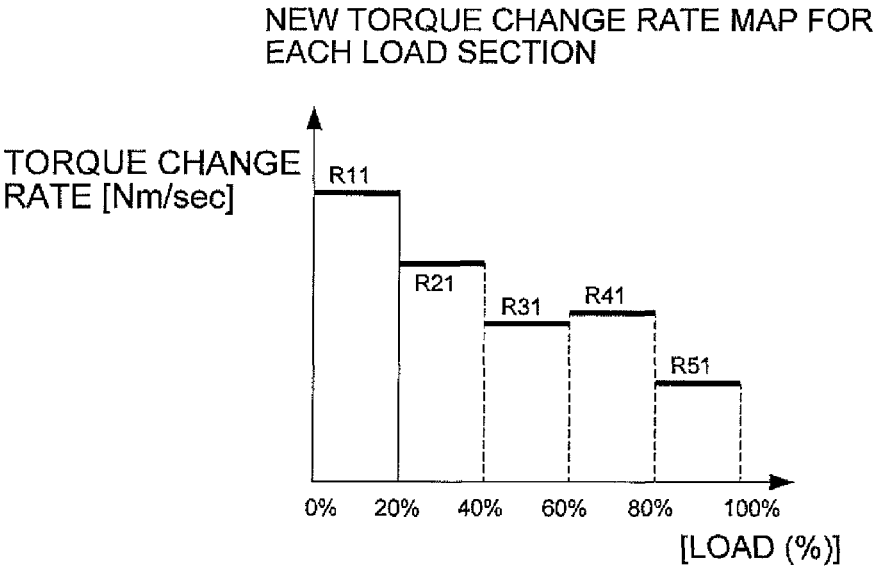

FIG. 7 is a diagram for describing an example of reflecting a new torque change rate map in a state where a dynamic characteristic of the engine is changed in the device for controlling the hydraulic pump in the construction machine according to the exemplary embodiment of the present disclosure. FIG. 8 is a diagram illustrating a correlation between a required load and an engine speed when a dynamic characteristic of the engine deteriorates in the device for controlling the hydraulic pump in the construction machine. FIG. 9 is a diagram illustrating an example of calculating a torque change rate for each load section when a dynamic characteristic of the engine deteriorates in the device for controlling the hydraulic pump in the construction machine. FIGS. 10 and 11 are diagrams illustrating an example, in which a new torque change rate map for each load range is made based on the new torque change rate of FIG. 9.

Hereinafter, an exemplary embodiment, in which the previous torque change rate map 220 is updated to the new torque change rate map 220*a*, will be described with reference to each step.

In the meantime, a torque change rate map loaded before a correction is referred to as the previous torque change rate map 220, and a newly generated torque change rate map is referred to as the new torque change rate map 220*a*.

Load applying step S10: A load is applied to the pump by performing a general operation.

Engine dynamic characteristic change checking step S20: When a large change, in which a dynamic characteristic of the engine deviates from a set permissible range, is represented, it is checked that the dynamic characteristic of the engine is changed.

That is, when the dynamic characteristic of the engine is maintained, or a degree of the change of the dynamic characteristic of the engine is within the set permissible range, the torque change rate map is not updated, and the operation is terminated.

This will be additionally described below. In the hydraulic system, the hydraulic pump discharges a flow rate according to a command of the joystick, and a main control valve (MCV) adjusts an operation speed of an actuator by distributing the discharged flow rate to each actuator. The engine provides power so that the hydraulic pump is capable of generating hydraulic energy. Matching between the hydraulic pump requiring power and the engine providing power applies as a significant factor in an aspect of controllability and fuel efficiency of the construction machine. Since a time to reach a maximum torque of the engine is longer compared to the required pump torque, an engine speed decrease phenomenon is generated due to a dynamic characteristic of the engine, in which power is insufficient when a load is sharply applied.

In the meantime, a rated engine speed for each load mode (power mode) is provided to the engine of the construction machine. The load mode may be divided according to heaviness and lightness of a load of the rated engine speed, and may be provided with, for example, an excessively heavy load mode 1,800 RPM, a heavy load mode 1,665 RPM, a standard load mode 1,560 RPM, and a light load mode 1,460 RPM. When an actual engine speed is lower than a rated engine speed of a corresponding load mode no matter what load mode is selected, fuel efficiency deteriorates.

In the exemplary embodiment according to the present disclosure, a case where an actual engine speed is decreased by an amount larger than a permissible range is set as the case where a dynamic characteristic of the engine is changed. Here, the permissible range may be 90 rpm to 110 rpm. That is, when an actual engine speed is decreased to be lower than the rated engine speed by 90 rpm, it may be more clearly recognized that a dynamic characteristic of the engine is changed. By contrast, the change within 90 rpm is a minor level, which is ignorable. Further, when an actual engine speed is decreased to be lower than the rated engine speed by 110 rpm, fuel efficiency may sharply deteriorate.

On the other hand, it can be seen that when there occurs an engine speed decrease phenomenon, in which an engine speed exceeds the aforementioned permissible range, fuel efficiency deteriorates. The reason is that the larger amount of fuel is consumed in order to increase the engine speed.

Input means selecting step S30: Input means such as a switch disposed on a dashboard, a joystick operating so as to operate an operating device, and the like is selected.

Pump load applying step S40: Pump torque is increased to designated torque with a predetermined change rate. There are several kinds of operations which may generate a load to the pump. For example, a command is generated by operating the joystick, and a load is applied to the pump while an operating device is actually operated through the command. As an operation example of the operating device, a load may be applied to the pump by performing boom raising and a swing operation.

Information collecting step S50: Various information generated when the load is applied to the pump in the pump load applying step S40 are collected. For example, information obtained when the operations of raising the boom and swinging upper body are performed may be collected. The collected information includes an engine speed obtained from the engine, boost pressure, a swash plate angle of the pump, pressure of working oil discharged from the pump, and the like. When a swash plate angle of the pump is recognized, it is possible to recognize a flow rate discharged per unit operation of a pump shaft from a pump, and a pump capacity may be calculated based on the flow rate information.

That is, when the pump capacity and the pressure of the working oil are recognized, it is possible to calculate a pump torque value, and when a development of an engine speed at a time, at which the pump torque is obtained, is investigated, it is possible to recognize a dynamic characteristic of the engine.

Map data generating step S60: A torque change rate is calculated based on the information collected in the information collecting step S50, and a torque change rate map is generated based on the torque change rate.

As illustrated in FIG. 8, when a dynamic characteristic of the engine is changed, an engine speed is differently represented even though the same required load is applied. Specifically, compared to a normal engine speed curve, in an abnormal engine speed curve, an engine speed is represented to be low in an unspecified load section.

Accordingly, a torque change rate is calculated for each load section by checking a time taken until a pump load reaches a corresponding load for each load section when the entire pump load is set to 100%.

For example, to investigate from the time point to, at which a load is applied to the pump by operating the joystick, to the first time t1, at which the pump load reaches up to 20%, in a case of a normal dynamic characteristic of the engine, an engine speed may be represented to be high, but when a dynamic characteristic of the engine is changed, as illustrated in the abnormal engine speed curve, a relatively low pump load is matched even at the same first time t1. In this case, a pump load matched to each of the first to fifth times t1 to t5 in the abnormal engine speed curve is referred to as a matched pump load.

That is, in a case of the normal dynamic characteristic of the engine, a torque change rate map having first to fifth torque change rates R1 to R5 is formed. However, according to the change of the dynamic characteristic of the engine, as illustrated in FIG. 9, new $11^{th}$, $21^{th}$, $31^{th}$, $41^{th}$, and $51^{th}$ torque change rates R11, R21, R31, R41, and R51 are generated for load sections, respectively.

Comparing step S70: An increase and a decrease of a torque change rate for each load section between the newly generated new $11^{th}$, $21^{th}$, $13^{th}$, $41^{th}$, and $51^{th}$ torque change rates R11, R21, R31, R41, and R51 and the existing first, second, third, fourth, and fifth torque change rates R1, R2, R3, R4, and R5 are compared as illustrated in FIG. 10.

In this case, whether a difference for each torque change rate exists within a permissible range is compared. When the difference is large so as to deviate from the permissible range, as illustrated in FIG. 11, the new torque change rate map 220*a* is generated by using the newly calculated $11^{th}$, $21^{th}$, $31^{th}$, $41^{th}$, and $51^{th}$ torque change rates R11, R21, R31, R41, and R51. When the difference for each torque change rate is minor so as not to deviate from the permissible range, the operation is terminated. Here, the permissible range may mean that an increase/decrease ratio of the new $11^{th}$, $21^{th}$, $31^{th}$, $41^{th}$, and $51^{th}$ torque change rates R11, R21, R31, R41, and R51 is 10% or more compared to the values of the first, second, third, fourth, and fifth torque change rates R1, R2, R3, R4, and R5 which are comparison targets.

Updating step S80: The previous torque change rate map 220 is updated to the newly generated new torque change rate map 220*a* as illustrated in FIG. 6 (see 230). Then, the new torque change rate map 220*a* is stored as a profile (240).

As described above, the pump is controlled by the corrected and newly loaded new torque change rate map 220*a*. That is, the torque calculating unit 200 calculates a torque value based on the new torque change rate map 220*a* newly loaded in the torque controller 200. Particularly, the torque controller 200 generates and outputs the first and second correction pump commands Pcmd11 and Pcmd22 to finally control the first and second hydraulic pumps P1 and P2 by reflecting a torque change rate value of the new torque change rate map 220*a*.

The aforementioned first and second correction pump commands Pcmd11 and Pcmd22 are finally generated by the new torque change rate map 220*a* to which the changed dynamic characteristic of the engine is reflected. The first and second hydraulic pumps P1 and P2 are controlled by the aforementioned first and second correction pump commands Pcmd11 and Pcmd22.

Hereinafter, an example, in which the hydraulic system is controlled by the new torque change rate map 220*a*, to which the changed dynamic characteristic of the engine is reflected, will be described with reference to FIG. 12.

Figure 12:
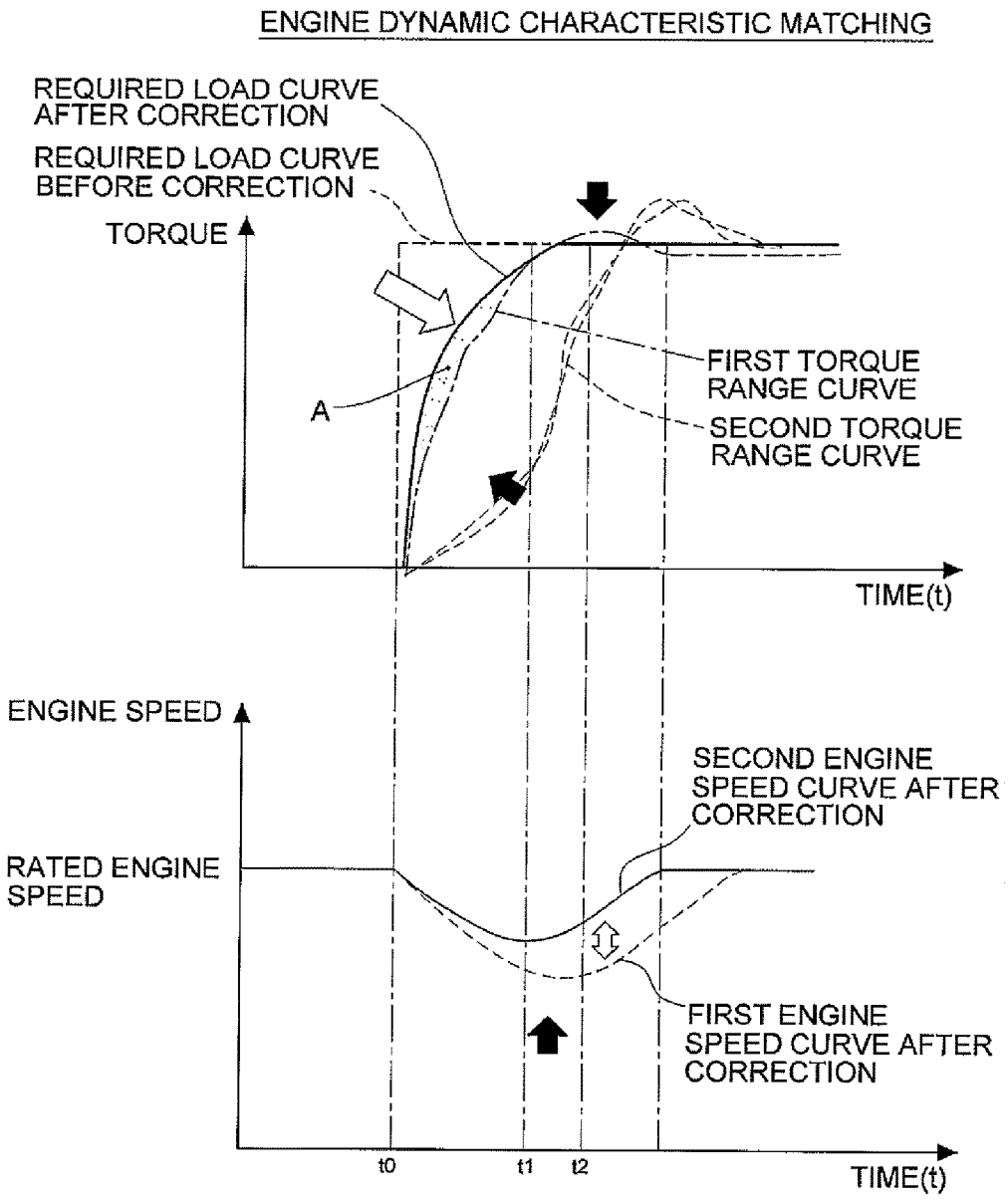
FIG. 12 is a diagram for describing a correlation between a load and an engine speed after a new torque change rate is applied in the device for controlling the hydraulic pump in the construction machine.

FIG. 12 is a diagram for describing a correlation between a load and an engine speed after the new torque change rate is applied in the device for controlling the hydraulic pump in the construction machine.

FIG. 12 illustrates a case where the first and second hydraulic pumps P1 and P2 are controlled by the first and second correction pump commands Pcmd11 and Pcmd22.

When the joystick is operated and a load is sharply applied, a maximum torque value is momentarily required according to the required load curve before the correction, but when a new torque change rate according to the present disclosure is applied, the required load curve is changed, and in this case, it can be seen that the required load is increased with a predetermined change rate when an increase development of the required load is investigated. That is, it can be seen that the increase development of the required load is increased according to the required load curve after the correction.

In the meantime, torque is varied according to a load applied to the pump, and when an operator actually operates a construction machine, a heavy load operation and a light load operation are mixed, so that the torque is expressed in a form having a range. The range of the torque may range from a first torque range curve and a second torque range curve as illustrated in FIG. 12.

In the meantime, as illustrated in FIG. 12, it can be seen that in the device for controlling the hydraulic pump in the construction machine according to the present disclosure, a difference between the required load curve after the correction and the first torque range curve is small. This can be recognized by comparing the required load curve before the correction and the first torque range curve. Here, when the difference between the required load curve and the torque range curve is small, the amount of drop of the engine speed is decreased.

That is, it can be seen that the device for controlling the hydraulic pump in the construction machine according to the present disclosure does not exhibit the drop phenomenon, in which an engine speed is sharply decreased and represents a preferable engine speed.

In the device for controlling the hydraulic pump in the construction machine, which is configured as described above, when normal output is not made due to deterioration or a change of an engine in the hydraulic system, in which a pressure control type electronic hydraulic pump is mounted, the hydraulic pump is controlled by the torque change rate map for each load range, to which a dynamic characteristic of the engine is reflected, so that it is possible to improve the amount of decrease of an engine speed according to a change in a pump load.

Further, the device for controlling the hydraulic pump in the construction machine according to the present disclosure may improve a degree of variation of a pump load and further improve performance of controlling an operating device.

On the other hand, it is possible to prevent fuel from being excessively consumed by the engine by applying a hydraulic load in consideration of a dynamic characteristic of the engine, thereby helping to improve fuel efficiency.

The exemplary embodiments of the present disclosure have been described with reference to the accompanying drawings, but those skilled in the art will understand that the present disclosure may be implemented in another specific form without changing the technical spirit or an essential feature thereof.

Accordingly, it will be understood that the aforementioned exemplary embodiments are described for illustration in all aspects and are not limited, and the scope of the present disclosure shall be represented by the claims to be described below, and all of the changes or modified forms induced from the meaning and the scope of the claims, and an equivalent concept thereof are included in the scope of the present disclosure.

The device and the method for controlling the hydraulic pump in the construction machine according to the present disclosure may be used for controlling a hydraulic pump by reflecting a dynamic characteristic of an engine.

What is claimed is:

1. A method for controlling a hydraulic pump in a construction machine, the method comprising:

an engine dynamic characteristic change checking step of checking whether a dynamic characteristic of an engine deviates from a predetermined permissible range when a load is applied to the hydraulic pump and a pump load reaches pump torque required by the hydraulic pump;

a pump load applying step of when the dynamic characteristic of the engine deviates from the predetermined permissible range in the engine dynamic characteristic change checking step, applying a pump load to the hydraulic pump so as to increase the pump torque to predetermined torque with a predetermined change rate;

an information collecting step of collecting information including engine speed information, swash plate angle information of the pump, and pressure information of discharged working oil, which is generated when the pump load is applied in the pump load applying step;

a map data generating step of defining load sections by dividing a load of the hydraulic pump into a plurality of load sections from a minimum level to a maximum level and generating a new torque change rate map by generating a torque change rate for each load section based on the information collected in the information collecting step; and an updating step for updating an existing torque change rate map to the new torque change rate map generated in the map data generating step, wherein the hydraulic pump is controlled by the new torque change rate map updated in the updating step.

2. The method of claim 1, wherein in the engine dynamic characteristic change checking step, a case where dynamic characteristic of an engine deviates from a predetermined permissible range is set to a case where an actual engine speed is decreased by an amount larger than between 90 to 110 rpm.

3. The method of claim 1, wherein the map data generating step includes generating the new torque change rate map by calculating each taken time to reach each load section at a normal engine speed, calculating a matched pump load, in which the each taken time is matched to the engine speed, defining a new torque change rate based on an amount of increase of the matched pump load at the each taken time, and calculating new torque change rates for each load sections, respectively.

4. The method of claim 1, wherein in the engine dynamic characteristic change checking step, when a degree of the change of the dynamic characteristic of the engine is within the permissible range, updating the torque change rate map is not performed.

5. The method of claim 1, further comprising:

a step of selecting an input means prior to the pump load applying step.

6. The method of claim 1, wherein the information collected in the information collecting step includes an engine speed, a boost pressure, a swash plate angle of the pump, and a pressure of working oil discharged from the pump.

7. The method of claim 1, further comprising:

a comparing step of comparing the new torque change rate newly generated in the map data generating step with an existing torque change rate for each load section, and determining whether a difference in a torque change rate between the new torque change rate and the existing torque change rate is within a permissible range, wherein when the difference in the torque change rate deviates from the permissible range in the comparing step, the new torque change rate map is generated based on the newly generated torque change rate.

8. The method of claim 7, wherein the permissible range of the difference in the torque change rate in the comparing step is 10% or more of an increase/decrease ratio of the new torque change rate to the existing torque change rate.

* * * * *